United States Patent [19]

Dhein et al.

[11] 4,362,635

[45] Dec. 7, 1982

[54] LACTONE-MODIFIED ESTER OILS

[75] Inventors: Rolf Dhein; Karl-Heinz Hentschel, both of Krefeld; Karl Nützel, Neulussheim; Klaus Morche, Mannheim; Wolfgang Schüle, Ketsch, all of Fed. Rep. of Germany

[73] Assignee: Bayer Aktiengesellschaft, Leverkusen, Fed. Rep. of Germany

[21] Appl. No.: 201,775

[22] Filed: Oct. 29, 1980

Related U.S. Application Data

[63] Continuation of Ser. No. 80,279, Oct. 1, 1979, abandoned.

[30] Foreign Application Priority Data

Oct. 5, 1978 [DE] Fed. Rep. of Germany ..... 2843473

[51] Int. Cl.[3] ..... C10M 1/26

[52] U.S. Cl. ..... 252/56 S; 560/185; 560/76

[58] Field of Search ..... 252/56 S; 560/185, 76

[56] References Cited

U.S. PATENT DOCUMENTS

| | | | |
|---|---|---|---|
| 3,773,822 | 11/1973 | Bäder et al. | 252/56 S |
| 4,130,532 | 12/1978 | Lamb | 560/185 |
| 4,133,794 | 1/1979 | Lamb | 560/185 |

*Primary Examiner*—Jacqueline V. Howard
*Attorney, Agent, or Firm*—Connolly and Hutz

[57] ABSTRACT

Esterification products of monoalcohols and dicarboxylic acids, or of polyhydric alcohols and monocarboxylic acids respectively, containing 5 to 45% by weight of units of hydroxycarboxylic acids and having a ratio of carbon to oxygen atoms greater than 4.1 obtained from (a) aliphatic $C_1$–$C_{14}$ alcohols, (b) aliphatic $C_4$–$C_{18}$ carboxylic acids and optionally cycloaliphatic $C_6$–$C_{12}$ and aromatic $C_7$–$C_{12}$ carboxylic acids, and (c) lactones of aliphatic $C_5$–$C_{12}$ hydroxycarboxylic acids. They are suitable for the preparation of lubricants and lubricant compositions.

8 Claims, No Drawings

LACTONE-MODIFIED ESTER OILS

CROSS REFERENCE TO RELATED APPLICATION

This application is a continuation of application Ser. No. 80,279 filed Oct. 1, 1979 now abandoned.

The present invention relates to ester oils of monohydric or polyhydric alcohols, dicarboxylic or monocarboxylic acids and lactones, and to lubricants and lubricant combinations containing such ester oils.

The petroleum fractions required for the production of for example motor oils contain on the one hand highly volatile constituents which adversely affect engine performance at high working temperatures and, on the other hand, substances which very quickly become viscous or even solid at low temperatures. The improved base oil obtained by separating off the volatile and crystallising fractions by distillation and treatment with urea does of course have a higher viscosity than before, resulting in poorer low-temperature characteristics in consequence of the increased low-temperature viscosities. For this reason, the base oils are frequently not subjected to this subsequent refining step (solvent extraction).

Although solvent extraction of the petroleum fractions has of late largely been replaced by the less expensive process of hydrorefining, the hydroraffinates are also attended albeit it to a lesser extent, by the above-mentioned disadvantages of solvent raffinates, such as for example unsatisfactory low temperature characteristics.

Recently, there has been an increase in the use of so-called multigrade oils which provide good engine performance at both winter and summer temperatures. These oils have a viscosity-temperature behaviour, for example minimal changes in viscosity with temperature and a high "viscosity index (V.I.)", which cannot be achieved by the base oil itself. Polymers added to the base oil, the so-called "V.I. Improvers", considerably increase the original viscosity and the viscosity index of the lubricating oil mixture, but unfortunately they are gradually destroyed during prolonged use in the engine by the intense shear forces acting on the lubricating film and are therefore altered by oxidation process so that the V.I.-increasing effect of these additives is gradually lost over a period of time.

Of the synthetic lubricants, the group of ester oils has proved to be particularly useful and valuable. Ester oils are either dicarboxylic acid esters of straight-chain, but preferably branched-chain monoalcohols, monocarboxylic acid esters of polyalcohols or neutral oligocondensates of monocarboxylic acid and/or dicarboxylic acids and/or polyalcohols ("complex ester oils").

Compared to mineral oils having similar viscosities, ester oils generally have a lower pour point, a higher flash point, lower volatility and a lower dependence of viscosity on temperature (high viscosity index, V.I.).

In many cases, these synthetic ester oils, for example esters of trimethyl adipic acid with aliphatic $C_6$–$C_{10}$ alcohols, are also mixed with mineral base oils. However, predominantly paraffin-based mineral oils to which esters of this type have been added generally cloud at temperatures as low as 0° C., a phenomenon which can even occur in mixed-based mineral oils, depending on the aromatic fraction content. Due to these difficulties, motor oils blended with esters of the type in question are no longer able satisfactorily to perform their function at low temperatures.

It is known for example from German Auslegeschrift No. 1,545,400 that the addition of 1,12-dodecanedioic acid di-2-ethyl hexyl ester to mineral base oils refined in the above mentioned way improves their characteristics such as pour point and V.I. However, it is difficult with this relatively low-viscosity ester (3.9 cSt/98.9° C.) alone to improve correspondingly the properties of more highly viscous mineral base oils without excessively reducing the original viscosity of the mixture.

For machine elements and engines, for example aircraft turbine engines, for machines of the type used in the ceramic industry, for drum furnaces of the type used in the inorganic insulating-material industry or for chain-transported tenter frames in the textile industry, in which temperatures above 170° C. occur, special ester oils having kinematic viscosities of ≧8 cSt/210° F. have hitherto proved to be extremely effective. However, many of these ester oils are still too volatile at temperatures of 170° C. and higher, even after the addition of oxidation inhibitors. Another disadvantage is the tendency which even the best of the currently known high-temperature ester oils have of either forming so many solid deposits or of undergoing such a considerable increase in viscosity after a few weeks, even at the operating temperatures most frequently encountered in practice of up to 200° C., that they are no longer adequately able to perform their function as lubricants.

It has now been found that condensation products of aliphatic monohydric or polyhydric alcohols, (cyclo)aliphatic or aromatic mono- or di-carboxylic acids and aliphatic hydroxycarboxylic acids or their lactones represent ester oils which do not have any of the disadvantages of the above-mentioned ester oils and which are eminently suitable for mixing with mineral base oils.

Accordingly, the present invention provides esterification products of (a) aliphatic $C_1$–$C_{14}$ alcohols containing one or more alcoholic hydroxyl groups;

(b) aliphatic $C_4$–$C_{18}$ mono- or di-carboxylic acids which may optionally be replaced by up to 55 mole percent of cycloaliphatic $C_6$–$C_{12}$ carboxylic acids and up to 5 mole percent of aromatic $C_7$–$C_{12}$ carboxylic acids; and (c) 6 to 9-membered lactones of aliphatic $C_5$–$C_{12}$ hydroxycarboxylic acids, characterised in that the units derived from the lactones make up between 5 and 45% by weight of the esters, in that the ratio of carbon to oxygen atoms is greater than 4.1 and in that either monoalcohols (a) and dicarboxylic acids (b) or polyhydric alcohols (a) and monocarboxylic acids (b) or polyhydric alcohols (a) and monocarboxylic acids (b) are used for producing the ester oils.

The above described low molecular weight and, hence, shear-stable ester oils stand out for their very high viscosity indices, low pour points and high compatability with mineral base oils. Accordingly, they are eminently suitable for improving the viscosity index of the mineral base oils, for lowering the pour point and, in addition, the increased viscosity of paraffin-based or naphthene-based base oils pretreated in known manner. Therefore, the need to add polymeric V.I. improvers may be largely or completely eliminated. Provided with suitable oxidation inhibitors, the more viscous of the oils according to the present invention (≧8 cSt/210° F.) show particularly low volatility at temperatures about 200° C. coupled with high long-term stability.

Principally it is possible to use the basic hydroxy alkyl carboxylic acids for producing the ester oils according to the present invention. In general, however, the more readily accessible 6 to 9-membered lactones of the corresponding aliphatic $C_5$–$C_{12}$ hydroxy carboxylic acids, such as ε-caprolactone, trimethyl-ε-caprolactone, oenanthic lactone and caprylolactone are used. It is preferred to use the lactones of the $C_5$–$C_6$ hydroxy carboxylic acids, above all the lactones of hydroxycaproic acids, ε-caprolactone being particularly preferred.

Oils having a higher lactone content than 45% by weight or a lower C/O ratio than 4.1 have less favourable mineral oil compatibilities and low-temperature properties. In the case of oils containing less than 5% by weight of lactone, the effect by which the viscosity index and/or the long-term stability at high temperatures is increased is inadequate. The use of larger amounts of branched cycloaliphatic or aromatic mono- or di-carboxylic acids or corresponding monoalcohols adversely affects the favourable viscosity-temperature behaviour of the oils according to the present invention.

Reaction products of lactones and mono- and polyhydric alcohols are already known, for example as valuable intermediate products for polyurethane resins, coating compositions and plasticisers. However, it could not be foreseen either that carboxylic acid esters of these reaction products would be highly compatible with mineral oils and would improve the properties of mineral base oils, or that they would represent excellent lubricants at relatively high temperatures of around 200° C. Thus, Gunderson-Hart for example, in a book entitled "Synthetic Lubricants", Reinhold Publishing Corp., New York, 1962, pages 392–394, describes the superior thermal stability of esters of polyalcohols containing quaternary β-carbon atoms, such as for example neopentyl glycol, trimethylol propane and pentaerythritol, in comparison with esters of alcohols containing free C-H-bonds on the β-carbon. By contrast, the more viscous (≧8 cSt) of the oils according to the present invention show excellent high-temperature properties, even at 200° C., although they contain ester bonds with free C-H-bonds on the β-carbon of the alcohol component.

Particularly advantageous properties have been afforded on the one hand by ester oils of from 5 to 25% by weight of one or more polyalcohols containing 2 to 12 carbon atoms and two or more alcoholic hydroxyl groups per molecule, from 5 to 45% by weight of ε-caprolactone and from 35 to 80% by weight of one or more aliphatic straight-chain or slightly branched carboxylic acids containing from 4 to 18 carbon atoms and, on the other hand, by ester oils of from 15 to 45% by weight of preferably straight-chain or slightly branched aliphatic dicarboxylic acids containing from 4 to 14 carbon atoms, from 5 to 45% by weight of ε-caprolactone and from 30 to 60% by weight of one or more straight-chain or slightly branched monoalcohols containing from 1 to 14 carbon atoms, the percentages by weight always adding up to 100%.

Suitable polyhydric alcohols are those containing from 2 to 12 carbon atoms and preferably from 4 to 8 carbon atoms, Polyhydric primary alcohols containing from 2 to 4 hydroxyl groups per molecule are preferred. Examples of alcohols such as these are ethylene groups, diethylene glycol, 1,4-butane diol, 1,6-hexane diol, trimethyl-1,6-hexane diol, 2,2-dimethyl-1,3-propane diol, 2-ethyl-1,3-propane diol, 2-ethyl-2-methyl-1,3-propane diol, 2,2-diethyl-1,3-propane diol, glycerol, trimethylol ethane, trimethylol propane, trimethylol butane, pentaerythritol, dipentaerythritol and neopentyl glycol monohydroxypivalate. It is particularly preferred to use the above-mentioned polyhydric primary alcohols containing a quaternary β-carbon atom.

Suitable monoalcohols are those containing from 1 to 14 and preferably from 4 to 10 carbon atoms, such as methanol, ethanol, propanol, butanol, pentanol, hexanol, heptanol, octanol, 2-ethyl hexanol, nonanol, trimethyl hexanol, decanol, undecanol, dodecanol, tridecanol, tetradecanol, ethylene glycol monoethyl ether, ethylene glycol monobutyl ether, diethylene glycol monoethyl ether, diethylene glycol monoethyl ether and diethylene glycol monobutyl ether.

These alcohols are reacted with from 5 to 45% by weight and preferably with from 10 to 35% by weight of, e.g., ε-caprolactone, based on the total weight of all the constituents required for the synthesis of the ester oil, by heating to 80° to 200° C. and preferably to 130°–180° C. in the presence of a suitable catalyst to form hydroxycarboxylic acid esters which are referred to hereinafter as lactone-modified alcohols.

The lactone-modified polyhydric alcohols are then esterified preferably with one or more aliphatic straight-chain or only slightly branched monocarboxylic acids containing from 4 to 18 and preferably from 6 to 12 carbon atoms. Examples of such carboxylic acids are butyric acid, valeric acid, caproic acid, oenanthic acid, caprylic acid, pelargonic acid, isononanoic acid, capric acid, undecanoic acid, lauric acid, tridecanoic acid, myristic acid, isopalmitic acid, isostearic acid, methyl heptanoic acids, α-ethyl caproic acid and trimethyl caproic acid.

The lactone-modified monoalcohols are preferably esterified with aliphatic straight-chain or slightly branched dicarboxylic acids containing from 4 to 14 and preferably from 6 to 12 C-atoms. Suitable dicarboxylic acids are for example succinic acid, glutaric acid, adipic acid, pimelic acid, suberic acid, azelaic acid, trimethyl adipic acid, sebacic acid, undecanedioic acid, dodecanedioic acid and succinic acids substituted by alkyl groups.

Up to 55 mole percent of the above-mentioned aliphatic mono- or di-carboxylic acids may be replaced by cycloaliphatic $C_6$–$C_{12}$ mono- or di-carboxylic acids and up to 5 mole percent by aromatic $C_7$–$C_{12}$ mono- or di-carboxylic acids, for example by 6-cyclohexyl caproic acid, cyclohexane carboxylic acid, cyclohexane-1,2-dicarboxylic acid, benzoic acid, phthalic acid and terephthalic acid.

For the low molecular weight dicarboxylic acids containing few carbon atoms, it is best to use monoalcohols of relatively high molecular weight and/or to modify the monoalcohols within the limits according to the present invention to obtain higher lactone/hydroxyl group equivalent ratios. Esters such as these are particularly suitable for use as mineral oil additives.

In order to minimise the volatility of the ester oils of the present invention, it is advisable for esterifying the polyalcohols of very low molecular weight (for example ethylene glycol) to use the longer-chain representatives of the above-mentioned monocarboxylic acids and/or to incorporate a higher percentage of lactone within the limits according to the present invention.

As high-temperature lubricating oils according to the present invention, it is best to use esters synthesised from polyalcohols having relatively high molecular weights and containing a relatively large number of hydroxyl groups and/or relatively long-chain monocarboxylic acids having a higher degree of branching (for example cyclohexane carboxylic acid) by comparison with the ester oils used for mixing with mineral lubricants.

Esterification is carried out either simply by heating a 10 to 30 mole percent excess of the carboxylic acid or carboxylic acid mixture with the lactone-modified polyhydric alcohols to temperatures of from 110° to 240° C. and preferably to temperatures of from 160° to 210° C. at normal or elevated pressure and separating off the water of reaction formed or else by azeotropic esterification in the presence of a solvent forming azeotropes with water, such as for example benzene, chlorobenzene, toluene or xylene, and heating to temperatures of from 80° to 240° C. and preferably to temperatures of from 140° to 210° C. with the removal of the azeotrope by distillation. To produce the lactone-modified dicarboxylic acid esters, the lactone-modified monoalcohol is first esterified by the above-described process with an excess of from about 5 to 20 equivalent percent of dicarboxylic acid up to as low a hydroxyl number as possible, after which an excess of the unmodified alcohol is added and the reaction is completed to as low an acid number as possible. Esterification may be carried out in the presence of acid catalysts, such as sulphuric acid, phosphoric acid, polyphosphoric acid, hydrogen sulphates, dihydrogen phosphates, aromatic sulphonic acids or trialkyl phosphates.

After the excess monocarboxylic acids or monoalcohols and, optionally, the solvent/water azeotrope have been distilled off, residues of catalyst, monocarboxylic acids or other impurities are removed by treating the crude ester oil with aqueous alkali solutions or finely powdered anhydrous alkalis, such as calcium oxide or anhydrous soda, or by stripping in a high vacuum.

The ester oils according to the present invention may of course also be composed of more than one monoalcohol, polyalcohol, monocarboxylic acid or dicarboxylic acid component.

Provided with suitable oxidation inhibitors, the esters according to the present invention represent valuable lubricants with outstanding long-term stability at 200° C. or may be added in quantities of from 1 to 90% by weight to naphthene-, paraffin- or mixed-based mineral base oils, preferably those which are obtained after a deparaffinating treatment and after distillation to remove the volatile constituents, whereby the viscosity-temperature behaviour of the resulting "partly synthetic" oil is improved. At the same time, it is possible to add small quantities of other standard lubricating oil additives, such as for example dispersants, detergents, corrosion inhibitors, oxidation inhibitors, antiwear, extreme-pressure additives viscosity index improvers and dyes.

Suitable oxidation inhibitors for use at high temperatures are for example those of the phenothiazine, phenylene diamine and diphenylamine type, but preferably those of the phenyl naphthylamine type are used.

The present invention is further illustrated by the following examples in which the percentages quoted always represent percentages by weight.

EXAMPLE 1

201 g of trimethylol propane and 342 g of ε-caprolactone are heated for 1 hour to 170° C. in the presence of 1 g of dibutyl tin oxide and the mixture is kept at that temperature for 4 hours. After cooling to 110° C., a mixture of 34.1 g of caproic acid, 439.3 g of caprylic acid, 276.4 g of capric acid and 7.6 g of lauric acid together with 130 ml of xylene are added. After refluxing 16 hours, 81 g of water have separated our and the acid number has fallen to 21 mg KOH/g. The xylene and the excess carboxylic acids are distilled off first in a water jet vacuum at 200° C. and then in a fine vacuum at 200° C./0.4 Torr. The crude oil is then extracted by shaking three times with 200 ml of 5% aqueous sodium hydroxide solution, washed until neutral with distilled water, dried, and then aftertreated with 5% by weight of basic aluminium oxide.

Yield: 1007 g (88% of theoretical).

$n_D^{20}=1.4591$, acid number: 0.1–0.2 mg KOH/g.

Hydroxyl number: 2 mg KOH/g.

EXAMPLE 2

201 g of trimethylol propane and 205.2 g of ε-caprolactone are heated for 1 hour to 170° C. in the presence of 2 g of dibutyl tin oxide and the mixture is kept at that temperature for 4 hours. 288 g of cyclohexane carboxylic acid, 319.5 g of isostearic acid and 150 ml of xylene are then added at 125° C., followed by refluxing for about 6 hours on a water separator until the acid number has fallen to 1.2 mg KOH/g. Following the addition of 270 g of lauric acid, refluxing is continued until a total of about 81 g of water has separated out and the final acid number of the mixture amounts to about 10 to 11, which is the case after another 7 hours. Working up is carried out in the same way as described in Example 1.

Yield: 1050 g (approximately 91% of theoretical).

$n_D^{20}=1.4717$, acid number: 0.1 mg KOH/g.

Hydroxyl number: 2 mg KOH/g.

COMPARISON TESTS

Approximately 5 ml of the oil prepared according to the procedure of Example 1 (="A") is poured into a flat porcelain dish, and the same operation is carried out with approximately 5 ml of the oil prepared according to the procedure of Example 2 ("B"). Both samples are provided with 5% of a standard commercial oxidation inhibitor based on phenyl naphthylamine and are stored for 420 hours at a temperature of 200° C. in the presence of air in a drying cabinet. After this time both oils are still liquid and contain hardly any sludge-like deposits. The evaporation loss amounts to 32% in the case of A and to 34% in the case of B. In contrast, a standard commercial high-temperature oil (the pentaerythritol ester of 2-hexyl capric acid) provided with 5% of the same oxidation inhibitor solidifies under the same conditions with an evaporation loss of 42%.

A comparison ester to Example 1 of the same constituents but without caprolactone had a viscosity at 210° F. (98.9° C.) of only 4.3 cSt. and hence could not be used as a high-temperature oil. In the described test, this oil also remained liquid with an evaporation loss of 74%. The caprolactone-free comparison ester analogous to that of Example 2 (kinematic viscosity at 210° F.=10.7 cSt; V.I. 128, pour point 24° C.) was highly viscous with an evaporation loss of 45%.

The following examples demonstrate the suitability of the oils according to the present invention for mixing with mineral base oils.

EXAMPLE 3

208 g (2 moles) of neopentyl glycol and 228 g (2 moles) of freshly distilled ε-caprolactone are heated for 1 hour to 170° C. in the presence of 1 g of dibutyl tin oxide and the mixture is kept at that temperature for 4 hours. After cooling to 110° C., 642.4 g (4.4 moles) of caprylic acid and 110 ml. of xylene are added. After 16 hours refluxing, 72 g of water have separated out and the acid number of the mixture has fallen to 34. Further working up is carried out in the same way as described in Example 1.

Yield: 850 g (approximately 90% of theoretical).

$n_D^{20}=1.4501$, acid number: 0.2 mg KOH/g.

Hydroxyl number: 1 mg KOH/g.

EXAMPLE 4

Following the procedure described in Example 3, 208 g of neopentyl glycol is reacted with 228 g of ε-caprolactone and then with a mixture of 30.4 g of caproic acid (0.26 mole), 391.7 g of caprylic acid (2.72 moles), 246.5 g of capric acid (1.43 moles) and 6.8 g of lauric acid (0.03 mole), up to a final acid number of approximately 22 mg KOH/g. Working up is carried out in the same way as described in Example 1.

Yield: 830 g (approximately 85% of theoretical).

$n_D^{20}=1.4522$, acid number: 0.1 mg KOH/g.

Hydroxyl number: 2 mg KOH/g.

The following Table shows the particularly high viscosity indices and the other important lubrication data:

TABLE 1

| Example No. | Visc. 100° F. (cSt) | Visc. 210° F. (cSt) | V.I. | Pour Point (°C.) | B.p. (°C.) |
|---|---|---|---|---|---|
| 1 | 50.7 | 8.8 | 165 | −47 | 275 |
| 2 | 111.7 | 14.2 | 139 | −15 | 298 |
| 3 | 17.6 | 4.33 | 177 | −66 | 216 |
| 4 | 23.2 | 5.31 | 187 | −53 | 244 |

EXAMPLE 5

The oil prepared by the method of Example 3 was added in different quantities by weight to a paraffin-based deparaffinated solvent raffinate freed from volatile constituents and having a viscosity of 38 cST (50° C.). The solvent raffinate had a V.I. of 105 and a pour point of −23° C.

Table 2 below shows the changes in the properties of the oil after the addition of increasing quantities of the ester oil according to the invention.

TABLE 2

| Addition of the oil in % by weight | Visc. at 50° C. (cSt) | V.I. | Pour Point (°C.) |
|---|---|---|---|
| 5 | 34 | 111 | −26 |
| 10 | 31 | 120 | −28 |
| 20 | 26 | 122 | −30 |

EXAMPLE 6

The oil prepared by the method of Example 4 was added to a solvent raffinate belonging to viscosity class 4.5° E/50° C. The changes in the property of the oil are shown in Table 3.

TABLE 3

| Addition of the oil in % by weight | Kin. visc. at 37.8° C. (cSt) | Kin. visc. at 98.9° C. (cSt) | V.I. | Pour Point | Evaporation loss according to Noack (DIN 51 581 |
|---|---|---|---|---|---|
| 0 | 56.4 | 7.44 | 102 | −29 | 12.5% |
| 5 | 51.2 | 6.92 | 101 | −29 | |
| 10 | 48.2 | 6.95 | 110 | −30 | |
| 20 | 42.4 | 6.66 | 119 | −30 | 11.5% |

The Noack evaporation loss of the pure ester prepared according to the procedure of Example 4 amounts to 5.4%. In contrast, a mixed ester of trimethyl adipic acid with aliphatic $C_8$–$C_{10}$ alcohols, of the type commonly used for mixing with mineral oils, shows the following evaporation losses (according to Noack):

Pure trimethyl adipic acid mixed ester—15.9%;

Mixture of 20% of trimethyl adipic acid mixed ester and 80% of solvent raffinate of Example 5—12.8%.

In contrast to the ester of the present invention prepared in Example 4, mixtures of the trimethyl adipic acid mixed ester with mineral base oils cloud at temperatures below +5° C.

EXAMPLE 7

In order to demonstrate the superior shear strength of the ester oil/mineral oil mixtures according to the present invention, the following two sample oils were subjected to shear stressing in accordance with DIN 51382.

(A) A mixture of 20% of the ester oil prepared according to the method of Example 4 and 80% of a solvent raffinate having a viscosity of 4.5° E/50° C.

(B) A mixture of 4% of a highly shear-stable polymeric viscosity index improver based on polymethacrylate and 96% of the same mineral base oil as used in (A).

The results of the shear strength test are set out in Table 4.

TABLE 4

| Shear Strength according to DIN 51382 | | | | |
|---|---|---|---|---|
| Oil Sample | Kin. visc. before* shear stressing | Kin. visc. after shear stressing | V.I. | Relative Reduction in viscosity in % |
| A | 6.71 cSt | 6.67 cSt | 120 | 0.6 |
| B | 8.69 cSt | 8.49 cSt | 120 | 2.3 |

*at 98.9° C. (210° F.)

We claim:

1. Esterification products of (a) aliphatic $C_1$–$C_{14}$ alcohols containing one or more alcoholic hydroxyl groups;

(b) aliphatic $C_4$–$C_{18}$ mono- or di-carboxylic acids which may optionally be replaced by up to 55 mole percent of cycloaliphatic $C_6$–$C_{12}$ carboxylic acids and up to 5 mole percent of aromatic $C_7$–$C_{12}$ carboxylic acids, and (c) 6 to 9-membered lactones of aliphatic $C_5$–$C_{12}$ hydroxycarboxylic acids, wherein:

the units derived from the lactones make up from 5 to 45% by weight of the esters;

the ratio of carbon to oxygen atoms is greater than 4.1 and either monoalcohols (a) and dicarboxylic acids (b) or polyhydric alcohols (a) and monocarboxylic acids (b) are used for producing the ester oils.

2. Ester oils as claimed in claim 1, containing from 10 to 35% by weight of hydroxycarboxylic acid units.

3. Ester oils as claimed in claims 1 or 2, wherein the ratio of carbon to oxygen atoms is greater than 4.4.

4. Ester oils as claimed in claim 1 of (a) 5 to 25% by weight of one or more aliphatic $C_2$–$C_{12}$ alcohols containing 2 or more OH-groups, (b) 35 to 80% by weight of one or more aliphatic straight-chain or slightly branched $C_4$–$C_{18}$ monocarboxylic acids and (c) ε-caprolactone, the sum of (a) (b) and (c) amounting to 100% by weight.

5. Ester oils as claimed in claim 4, wherein polyhydric primary alcohols containing a quaternary β-carbon atom are used as component (a).

6. Ester oils as claimed in claim 1 of (a) 30 to 60% by weight of one or more aliphatic straight-chain or slightly branched $C_1$–$C_{14}$ monoalcohols, (b) 15 to 45% by weight of one or more aliphatic straight-chain or slightly branched $C_4$–$C_{14}$ dicarboxylic acids, and (c) ε-caprolactone, the sum of (a) (b) and (c) amounting to 100% by weight.

7. A lubricant composition comprising one or more ester oils of the type claimed in claim 1, an oxidation inhibitor and, optionally, other standard lubricating oil additives.

8. A lubricant composition comprising (a) 1 to 90% by weight of one or more of the ester oils claimed in claim 1, (b) 99 to 10% by weight of a paraffin-, naphthene- or mixed-based mineral base oil and a small amount of other standard lubricating oil additives.

* * * * *